US005797510A

United States Patent [19]

Carrier et al.

[11] Patent Number: 5,797,510

[45] Date of Patent: Aug. 25, 1998

[54] PLASTICS MATERIAL PACKAGING FOR LONG-TERM STORAGE OF FOOD

[75] Inventors: André Carrier, Donzenac; Bruneau Couvrat-Desvergnes, Brive; Nicolas de Lambert, Ecully; Bernard Pommaret, Brive, all of France

[73] Assignee: Compagnie Gervais Danone, Levallois-Perret, France

[21] Appl. No.: 613,551

[22] Filed: Mar. 11, 1996

Related U.S. Application Data

[63] Continuation of Ser. No. 181,058, Jan. 14, 1994, abandoned.

[30] Foreign Application Priority Data

Jan. 14, 1993 [FR] France ..... 93 00282

[51] Int. Cl.[6] ..... B65D 17/00; B65D 101/00

[52] U.S. Cl. ..... 220/266; 220/270; 220/359; 215/232

[58] Field of Search ..... 426/106, 122, 426/123, 127; 53/133; 220/359, 266, 270; 215/232, 250, 253

[56] References Cited

U.S. PATENT DOCUMENTS

| | | | |
|---|---|---|---|
| 2,759,656 | 8/1956 | Abrams . | |
| 2,941,660 | 6/1960 | Tupper . | |
| 4,948,006 | 8/1990 | Okabe et al. | 426/403.1 |

FOREIGN PATENT DOCUMENTS

| | | |
|---|---|---|
| 14278/55 | 6/1956 | Australia . |
| 66409/60 | 11/1962 | Australia . |
| 24650/67 | 1/1969 | Australia . |
| 61905/73 | 5/1975 | Australia . |
| 44114/79 | 8/1979 | Australia . |
| WO87/01098 | 2/1987 | European Pat. Off. . |
| WO92/03355 | 3/1992 | European Pat. Off. . |
| 2291111 | 6/1976 | France . |
| 2611663 | 9/1988 | France . |
| WO93/23306 | 11/1993 | WIPO . |

*Primary Examiner*—Anthony J. Weier
*Attorney, Agent, or Firm*—Lowe, Price, LeBlanc & Becker

[57] ABSTRACT

Plastics material packaging includes a receptacle having a bottom and a sidewall which present an annular rim around its edge remote from the bottom, said rim providing an area for sealing a closure membrane, and the packaging further includes a cover applied to the receptacle over said membrane which it encloses. The cover is secured to the receptacle by a permanent connection that can be disconnected when the packaging is opened only by being broken, which connection is advantageously constituted by a discrete number of breakable tampering indicators. The invention also provides a method of manufacturing such packaging for long-term storage of food.

10 Claims, 4 Drawing Sheets

PLASTICS MATERIAL PACKAGING FOR LONG-TERM STORAGE OF FOOD

This application is a continuation of application Ser. No. 08/181,058, filed Jan. 14, 1994, now abandoned.

The invention relates to plastics material packaging for long-term storage of food at ambient temperature, and to a method of manufacturing it.

BACKGROUND OF THE INVENTION

The invention relates in particular to such packaging that is well suited to packaging food in a factory under excellent conditions of hygiene, which food is to be heated in the same packaging either in a bain-marie or in a microwave oven. Although packaging of this type as disclosed in WO-92/03355 gives satisfaction firstly in that it makes it possible to eat the hot food directly from the packaging itself (without risk of getting burnt) and secondly in that it includes a cover that protects the closure membrane of the receptacle containing the food, it is relatively difficult to manufacture in that it must be fabricated by applying deep thermoforming to a sheet of composite material, i.e. by a technique that is both expensive and slow, i.e. that has a fabrication rate that is not adapted to the throughput required by a factory for packaging foodstuffs at a high rate. Furthermore, the packaging of the above-specified international patent application does not include means enabling the consumer to be certain that the cover has not been separated from the receptacle in non-authorized manner to gain access to the contents of the receptacle between leaving the factory and the contents being eaten, as is generally desirable for human foodstuffs, and even more strictly for baby foods.

OBJECTS AND SUMMARY OF THE INVENTION

Consequently a general object of the invention is to provide plastics material packaging for long-term storage of food at ambient temperature which, while retaining the qualities of the known packaging, firstly avoids the cost and manufacturing throughput drawbacks thereof and secondly is capable of being provided with tampering indicator means.

In this respect, an object of the invention is to provide such packaging which is not only economically acceptable as to cost and manufacturing throughput, but which is also advantageous from a sales point of view by virtue of its labelling and its presentation on the site of sale.

Another object of the invention is to provide a method for the manufacture of such packaging.

According to the invention, plastics material packaging comprising a receptacle having a bottom and a sidewall which presents an annular rim around its edge remote from the bottom, said rim providing an area for sealing a closure membrane, and the package further including a cover applied to the receptacle over said membrane which it encloses, wherein the cover is secured to the receptacle via a permanent connection which, while the package is being opened, cannot be disconnected without being destroyed.

Such a connection may be a weld, adhesive, riveting, or of an analogous type.

In a preferred embodiment, the cover is secured to the receptacle by a discrete number of breakable tampering indicators.

Advantageously, the tampering indicators are constituted by pair(s) of lugs projecting radially from the periphery of the cover and from the receptacle proper, or from a member fixed to the receptacle.

According to another characteristic of the invention, the lugs of the receptacle or of the member which is secured thereto, and the lugs of the cover are connected together by ultrasonic welding, i.e. a technique that causes plastics material to migrate from one lug into the other, thereby ensuring particularly effective connection of the cover and the receptacle, thus guaranteeing the packaging against breaking in.

In one embodiment, the receptacle is bowl-shaped and is made from a composite sheet of plastics material of the polypropylene/EVOH/polypropylene type.

When the packaging is provided with four pairs of lugs, which preferably carry a message explaining how to break them in order to separate the cover from the receptacle, provision is made firstly to position a label identifying the contents of the package relative to the said lugs, and secondly to make use of said lugs for grouping together a plurality of packages in a cardboard box or the like for the purposes of transporting them and of displaying them at sites where they are sold.

The invention also provides plastics material packaging comprising a receptacle having a bottom and a sidewall which presents an annular rim around its edge remote from the bottom, said rim providing an area for sealing a closure membrane, wherein the cover is secured to the receptacle by means of a skirt fixed to said receptacle via said rim.

In such packaging, the invention also provides tampering indicators that can be broken when the package is opened and that are provided both on the cover and on the skirt, advantageously as pairs of lugs that project radially from the periphery of the skirt and of the cover, the lugs of the skirt and those of the cover being connected together by ultrasonic spot welding.

The invention also provides a method of manufacturing packaging as defined above, wherein:

the rim of a receptacle filled with a foodstuff and closed by a membrane is placed on the annular collar of a skirt provided with first radial lugs around its periphery and the collar of the skirt is fixed to the rim of the receptacle;

a cover provided with second radial lugs of shape and disposition complementary to those of said first lugs on the skirt is placed on the subassembly formed in this way; and the lugs of the skirt are secured to the lugs of the cover.

In a preferred implementation, the fixing of the skirt to the receptacle and the fixing of the lugs to one another are performed by ultrasonic multiple spot welding.

In a variant, the skirt is fixed to the receptacle and/or the lugs are fixed to one another by means of an adhesive.

In yet another variant, the skirt is fixed to the receptacle and/or the lugs are fixed to one another by riveting or the like.

The method of the invention makes it possible to manufacture packages at a high rate, which may be of the order of about 60 units per minute.

BRIEF DESCRIPTION OF THE DRAWINGS

The invention will be well understood from the following description given by way of example and made with reference to the accompanying drawings, in which.

MORE DETAILED DESCRIPTION

Figure 1:
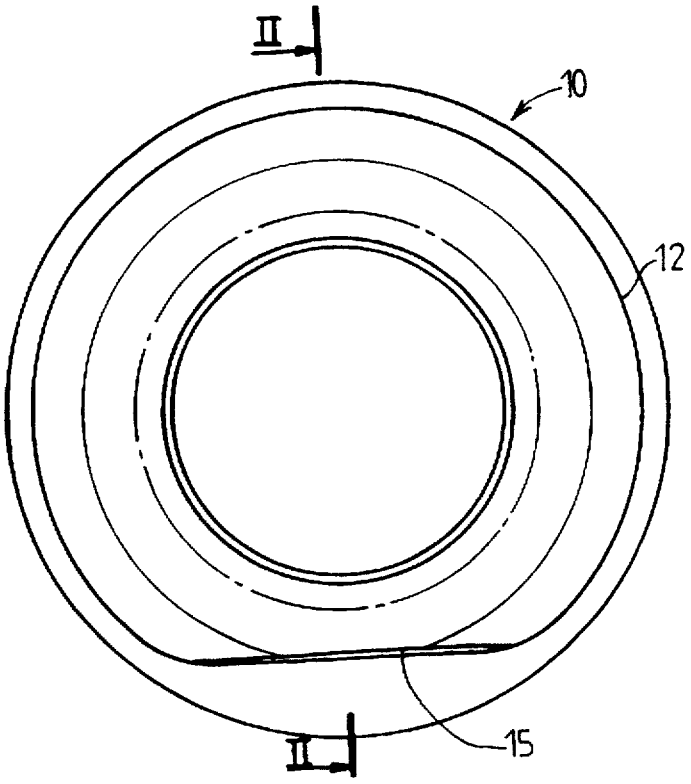
FIG. 1 is a plan view of a receptacle constituting a package of the invention.
Figure 2:
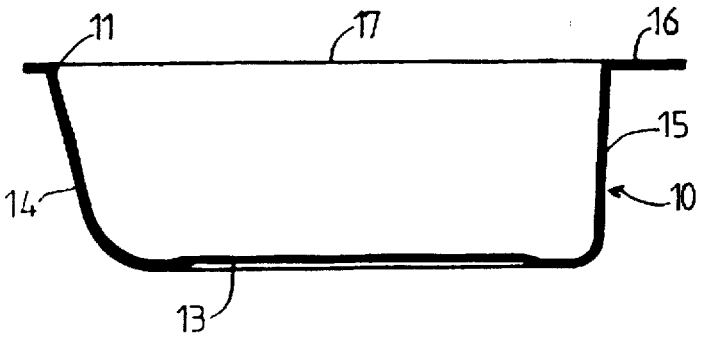
FIG. 2 is a section view on line II—II of FIG. 1.

Plastics material packaging for long-term storage of food at ambient temperature and intended (although this particular indication is not limiting in any way) to be eaten, preferably hot, without any need to be transferred from said original packaging, comprises a receptacle 10 (FIGS. 1 and 2) generally in the form of a dish or bowl in the embodiment described and shown having a capacity that may lie in the range 100 grams (g) to 250 g. The opening 11 in the receptacle 10 is surrounded by an annular rim 12 and has a bottom 13, a side wall 14 including a flap 15, and on the top face 16 of the annular rim 12 a sealing area for a closure membrane 17. The receptacle 10 is advantageously made from a sheet of a single plastics material, or preferably from a composite sheet enabling it to be heated in a bain-marie or in a microwave oven and also serving to provide "barrier" properties opposing gas interchanges, thereby enabling the substance contained in the receptacle 10 to have a very long storage life at ambient temperature (not less than 12 months), where an example of such a composite sheet is a polypropylene/EVOH/polypropylene complex.

The above-described receptacle 10 is associated with a cover 20 (FIGS. 5, 6, and 7), which encloses and protects the membrane 17 until the cover is removed from the package and which, in accordance with the invention, is secured to the receptacle 10 by a permanent connection that can be broken only by being destroyed while the package is being opened.

In one embodiment, this connection is the result of a collar on the cover being stuck to the rim 12 by means of adhesive.

In a variant, the cover is fixed to the rim 12 by rivets of plastics material.

Figure 3:
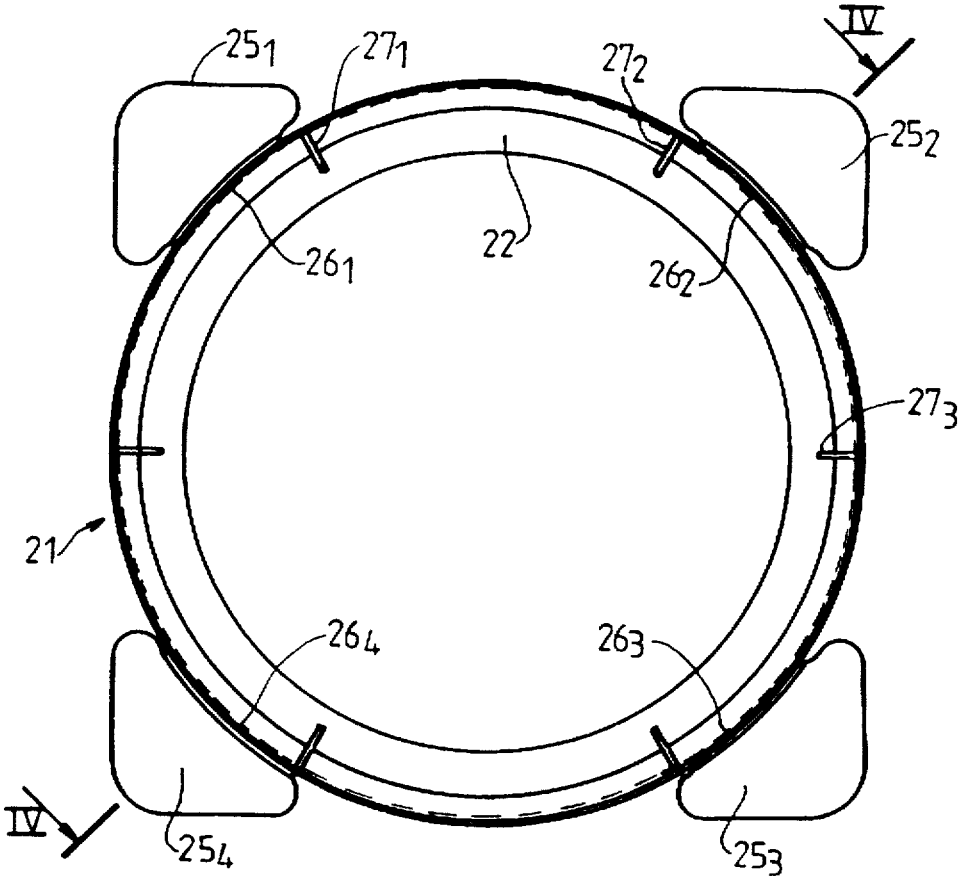
FIG. 3 is a plan view of a skirt of the package.
Figure 4:
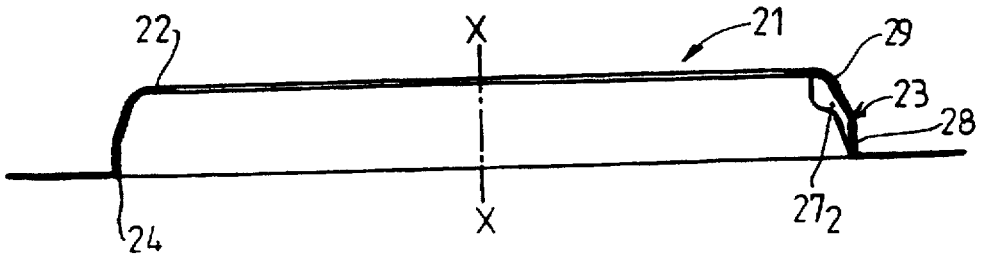
FIG. 4 is a section view on line IV—IV of FIG. 3.

In the embodiment described and shown, this connection makes use of welding and it is constituted by breakable tampering indicators provided both on said cover and on a skirt 21 (FIGS. 3 and 4) that is fixed to the receptacle 10 via the rim 12. More precisely, the skirt 21 is generally ring-shaped and comprises a sidewall 23 that is partially cylindrical (as shown at 28) and partially frustoconical (as shown at 29), with the frustoconical portion being connected via a fillet to an annular collar 22 that extends in a plane substantially perpendicular to the axis X—X of the skirt. At its free edge 24, the sidewall 23 includes first radial lugs $\mathbf{25}_1$, $\mathbf{25}_2$, $\mathbf{25}_3$, and $\mathbf{25}_4$ disposed at 90° intervals from one another and each connected to said wall 23 by one or more bridges $\mathbf{26}_1$, $\mathbf{26}_2$, $\mathbf{26}_3$, and $\mathbf{26}_4$ that can be broken by twisting. Stacking ribs such as $\mathbf{27}_1$, $\mathbf{27}_2$, $\mathbf{27}_3$, . . . are provided inside the skirt to facilitate handling.

Figure 5:
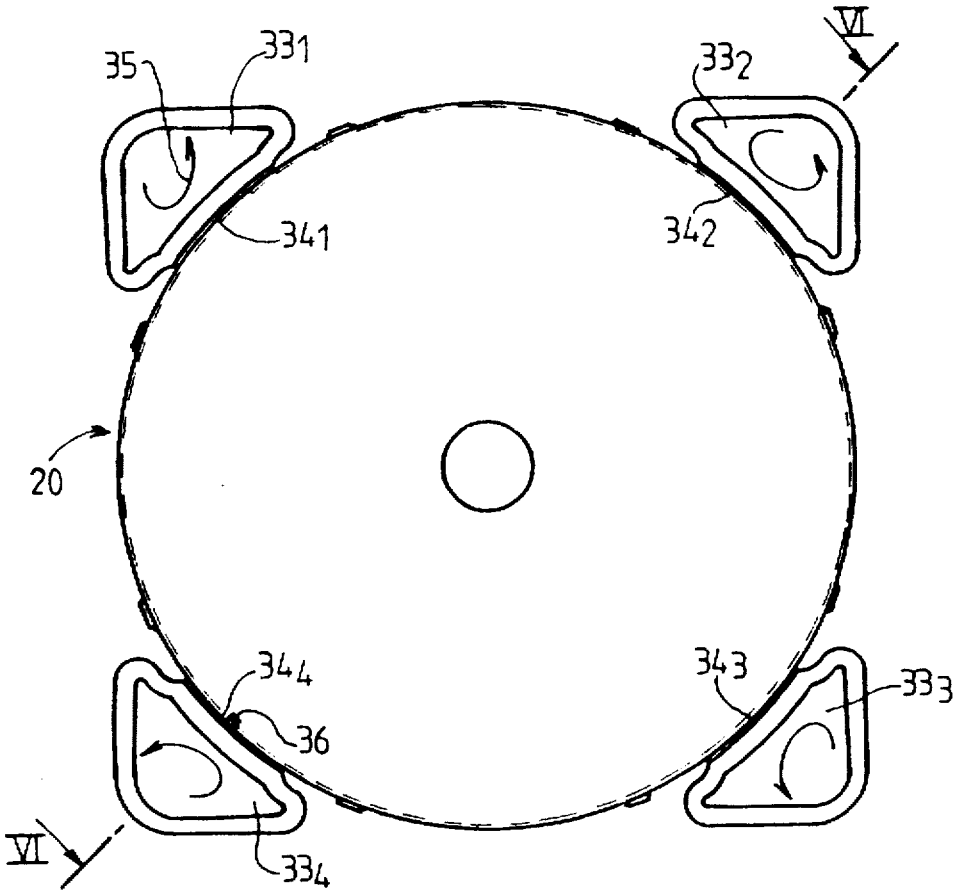
FIG. 5 is a view of a cover of a package of the invention.
Figure 6:
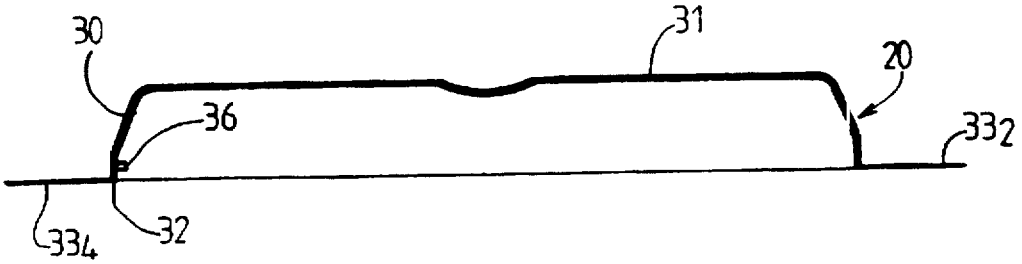
FIG. 6 is a section view on line VI—VI of FIG. 5.

As clearly visible in FIGS. 5 and 6, the cover 20 is closed by a disk 31 and its sidewall 30 which is similar in shape to the sidewall 23 of the skirt 21 has second radial lugs $\mathbf{33}_1$, $\mathbf{33}_2$, $\mathbf{33}_3$, and $\mathbf{33}_4$ on its own free edge 32, which lugs are complementary in shape and disposition to the lugs 25 and on their top faces they carry messages 35 that may be in writing or in the form of pictograms, explaining how they are to be used. In similar manner to the lugs 25, the lugs 33 are connected to the wall 30 by bridges $\mathbf{34}_1$, $\mathbf{34}_2$, $\mathbf{34}_3$, and $\mathbf{34}_4$ that can be broken by twisting.

On the inside surface of the sidewall 30 and in the vicinity of its free edge 32, the cover 20 is provided with bosses such as 36 (FIGS. 5 and 6) which serve during assembly to keep the cover at a distance from the remainder of the package so as to create chimney gaps such as c for a purpose that is explained below.

Figure 7:
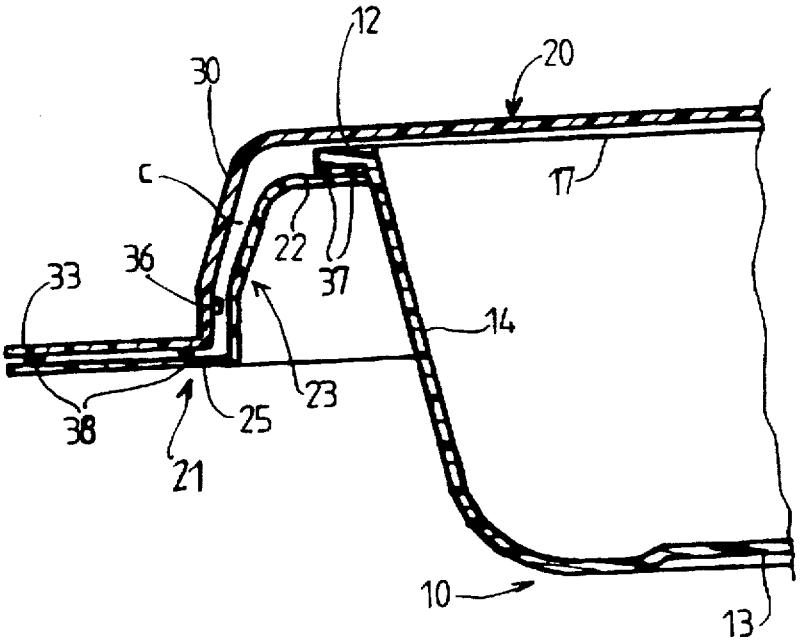
FIG. 7 is a fragmentary view in section and on a larger scale through a completed package.

To make a package of the invention from its component parts as described above, the skirt 21 is initially fixed to the receptacle 10, advantageously by ultrasonic spot welding of the bottom face of the rim 12 to the collar 22 of the skirt, as referenced 37 in FIG. 7, and thereafter the lugs 25 and 33 of the skirt and of the cover are fixed together, preferably likewise by ultrasonic spot welding, as referenced 38 in the same figure. Such a technique causes plastics material to migrate from one lug to the other and ensures particularly effective connection between the cover 20 and the skirt 21, thereby guaranteeing that the package is tamperproof.

A method of the invention makes it possible to obtain a practical manufacturing throughput of the order of 60 packages per minute, including placing a label in position relative to the lugs prior to grouping packages together in cardboard boxes in which they are held in place by their lugs, ready to be put on display for sale as soon as the box is opened.

In addition, by means of its skirt 21, a package of the invention allows the consumer to avoid getting burnt when eating the contents of the receptacle after it has been heated in a bain-marie or in a microwave oven. For this purpose, the membrane 17 which is advantageously a composite sheet of polypropylene/aluminum/polyethylene is initially pierced or removed after the cover has been disconnected from the receptacle, and when the cover is put back on the skirt, the steam given off during heating can escape through the chimney gaps c.

We claim:

1. A reclosable four-part plastics material packaging comprising:

a receptacle having a bottom and a sidewall including an annular rim around an edge remote from the bottom, said rim having a top face, a bottom face and an outward face;

a skirt secured to said bottom face of said rim and comprising a first sidewall extending outwardly and downwardly from said rim and having a first peripheral edge, said skirt including breakable skirt lugs protecting outwardly from said first peripheral edge;

a substantially flat closure membrane sealed on a top face of said rim; and a cover applied to the receptacle over said membrane and said skirt, the cover enclosing the membrane and including a disk, a second sidewall extending outwardly and downwardly from said disk and having a second peripheral edge, said second sidewall having substantially the same shape as said first sidewall, and breakable cover lugs protecting outwardly from said second peripheral edge, wherein the skirt lugs and the cover lugs are secured to one another and wherein the cover is secured to the skirt only by said skirt breakable lugs and said cover breakable lugs, said lugs forming tampering indicators for the opening of the cover when the lugs are broken off from the cover, further comprising spacing means for keeping the cover at a distance from the skirt during assembly so as to create chimney gaps.

2. A reclosable four-part plastics material packaging comprising:

a receptacle having a bottom and a sidewall including an annular rim around an edge remote from the bottom, said rim having a top face, a bottom face and an outward face;

a skirt secured to said bottom face of said rim and comprising a first sidewall extending outwardly and downwardly from said rim and having a first peripheral edge, said skirt including breakable skirt lugs projecting outwardly from said first peripheral edge;

a substantially flat closure membrane sealed on a top face of said rim; and a cover applied to the receptacle over said membrane and said skirt, the cover enclosing the membrane and including a disk, a second sidewall extending outwardly and downwardly from said disk and having a second peripheral edge, said second sidewall having substantially the same shape as said first sidewall, and breakable cover lugs projecting outwardly from said second peripheral edge, wherein the skirt lugs and the cover lugs are secured to one another and wherein the cover is secured to the skirt only by said skirt breakable lugs and said cover breakable lugs, said lugs forming tampering indicators for the opening of the cover when the lugs are broken off from the cover.

3. Packaging according to claim 2, wherein the skirt lugs and the cover lugs are connected together by ultrasonic welding.

4. Packaging according to claim 2 wherein the lugs include four lugs that are evenly spaced about the rim having writing disposed thereon instructing how to break the lugs to enable separation of the cover and the receptacle.

5. Packing according to claim 2, wherein the receptacle is bowl shaped and is made from a composite sheet of polypropylene/EVAH/polypropylene type plastics material.

6. Packaging according to claim 2, wherein the packaging is adapted to receive contents therein; the package further comprising a label identifying the contents.

7. Packaging according to claim 2, wherein the skirt lugs and the cover lugs are connected together by ultrasonic spot welding.

8. The packaging of claim 2, wherein said first and second sidewalls are structured such that the cover, following removal from the receptacle, can be positioned and self-centered on the receptacle in a covering position.

9. A reclosable four-part plastics material packaging comprising:

a receptacle having a bottom and a sidewall including an annular rim around an edge remote from the bottom, said rim having a top face, a bottom face and an outward face;

a skirt secured to said bottom face of said rim and comprising a first sidewall extending outwardly and downwardly from said rim and having a first peripheral edge, said skirt including breakable skirt lugs projecting outwardly from said first peripheral edge;

a substantially flat closure membrane sealed on a top face of said rim; and a cover applied to the receptacle over said membrane and said skirt, the cover enclosing the membrane and including a disk, a second sidewall extending outwardly and downwardly from said disk and having a second peripheral edge, said second sidewall having substantially the same shape as said first sidewall, and breakable cover lugs projecting outwardly from said second peripheral edge, wherein the skirt lugs and the cover lugs are secured to one another and wherein the cover is secured to the skirt only by said skirt breakable lugs and said cover breakable lugs, said lugs forming tampering indicators for the opening of the cover when the lugs are broken off from the cover, further comprising a series of chimney gaps formed between the cover and the skirt.

10. A reclosable plastics material packaging comprising:

a receptacle having a bottom and a sidewall including an annular rim around an edge remote from the bottom, said rim having a top face, a bottom face and an outward face;

a skirt secured to said rim and comprising a first sidewall extending outwardly and downwardly from said rim and having a first peripheral edge, said skirt including breakable skirt lugs projecting outwardly from said first peripheral edge;

a substantially flat closure membrane sealed on said rim; and a cover applied to the receptacle over said membrane and said skirt, the cover enclosing the membrane and including a disk, a second sidewall extending outwardly and downwardly from said disk and having a second peripheral edge, said second sidewall having substantially the same shape as said first sidewall, and breakable cover lugs projecting outwardly from said second peripheral edge, wherein the skirt lugs and the cover lugs are secured to one another and wherein the cover is secured to the skirt only by said skirt breakable lugs and said cover breakable lugs, wherein, in a closed position with the lugs broken, said first and second peripheral edges being disposed elevationally beneath said rim in radially outwardly spaced relationship from the receptacle and the substantially same shapes of said first and second sidewalls being operable to self-center the cover on the receptacle and thereby close the receptacle.

* * * * *